US010480910B2

(12) United States Patent
Scholtes et al.

(10) Patent No.: US 10,480,910 B2
(45) Date of Patent: Nov. 19, 2019

(54) INTEGRATED CIRCUIT INITIATOR DEVICE

(71) Applicant: Nederlandse Organisatie voor toegepast-natuuwetenschappelijk onderzoek TNO, The Hague (NL)

(72) Inventors: Jozef Hubertus Gerardus Scholtes, The Hague (NL); Wilhelmus Cornelis Prinse, The Hague (NL); Marcus Johannes van der Lans, The Hague (NL)

(73) Assignee: Nederlandse Organisatie voor toegepast-natuurwetenschappelijk onderzoek TNO, 's-Gravenhage (NL)

( * ) Notice: Subject to any disclaimer, the term of this patent is extended or adjusted under 35 U.S.C. 154(b) by 0 days.

(21) Appl. No.: 15/738,399

(22) PCT Filed: Jun. 27, 2016

(86) PCT No.: PCT/NL2016/050453
§ 371 (c)(1),
(2) Date: Dec. 20, 2017

(87) PCT Pub. No.: WO2016/209081
PCT Pub. Date: Dec. 29, 2016

(65) Prior Publication Data

US 2018/0172410 A1 Jun. 21, 2018

(30) Foreign Application Priority Data

Jun. 26, 2015 (EP) ..... 15174123

(51) Int. Cl.
*F42B 3/13* (2006.01)
*F42B 3/198* (2006.01)
(Continued)

(52) U.S. Cl.
CPC ..... *F42B 3/13* (2013.01); *F42B 3/121* (2013.01); *F42B 3/124* (2013.01); *F42B 3/198* (2013.01); *F42C 19/0811* (2013.01)

(58) Field of Classification Search
CPC ..... F42B 3/10; F42B 3/12; F42B 3/13; F42B 3/195; F42B 3/198; F42C 19/08; F42C 19/0811
(Continued)

(56) References Cited

U.S. PATENT DOCUMENTS 4,840,122 A 6/1989 Nerheim
4,862,803 A * 9/1989 Nerheim ..... F42B 3/13 102/202.5

(Continued)

FOREIGN PATENT DOCUMENTS

WO 93/24803 A1 12/1993
WO WO 97/42462 A1 11/1997

OTHER PUBLICATIONS

European Patent Office, International Search Report in corresponding International Application No. PCT/NL2016/050453 dated Sep. 29, 2016 (2 pages).

(Continued)

*Primary Examiner* — James S Bergin
(74) *Attorney, Agent, or Firm* — Leydig, Voit & Mayer, Ltd.

(57) ABSTRACT

In an aspect of the invention there is provided an integrated circuit initiator device that comprises a circuit substrate provided with an electrical insulating layer; an electrical conducting bridge circuit deposited on the insulating layer; said bridge circuit patterned as contact areas and a bridge structure connecting the contact areas, said bridge structure arranged for forming a plasma when the bridge structure is fused by a initiator circuit that contacts the contact areas; and
(Continued)

a polymer layer that is spin-coated on the bridge structure, for forming a flyer that is propelled away from the substrate.

10 Claims, 6 Drawing Sheets

(51) Int. Cl.
*F42B 3/12* (2006.01)
*F42C 19/08* (2006.01)

(58) Field of Classification Search
USPC ..... 102/202.5, 202.7, 202.8
See application file for complete search history.

(56) References Cited

U.S. PATENT DOCUMENTS 5,327,834 A * 7/1994 Atkeson ..... F42B 3/13 102/202.1
6,133,146 A * 10/2000 Martinez-Tovar ..... F42B 3/13 102/202.3
7,581,496 B2 * 9/2009 Hennings ..... F42B 3/124 102/202.5
8,291,824 B1 10/2012 Welle et al.
8,468,944 B2 * 6/2013 Givens ..... F42B 3/121 102/275.11
9,568,288 B2 * 2/2017 Carpenter ..... F42B 3/124
2008/0148982 A1 6/2008 Hennings et al.
2018/0172410 A1 * 6/2018 Scholtes ..... F42B 3/13

OTHER PUBLICATIONS

K.D. Marx et al., "Characterization and Electrical Modeling of Semiconductor Bridges," Sandia Report, SAND97-8246,UC-706, Unlimited Release, pp. 1-42, Printed Mar. 1997.

* cited by examiner

INTEGRATED CIRCUIT INITIATOR DEVICE

CROSS-REFERENCE TO RELATED APPLICATIONS

This patent application is a U.S. National Phase of PCT International Application No. PCT/NL2016/050453, filed Jun. 27, 2016, which claims priority to European Application No. 15174123.8, filed Jun. 26, 2015, which are both expressly incorporated by reference in their entireties, including any references contained therein.

FIELD

The present invention relates to an initiator device and a method for manufacturing such.

BACKGROUND

In modern defense operations, munitions must meet various requirements. Besides that, there is also a need for new munitions types such adaptive munitions or munitions that possess e.g. scalable functionality. Making these kind of functionality possible, fast (microsecond), reliable and small initiators are needed. In most munitions, standard initiators with primary explosives and conventional mechanical parts are used, both are often a source of trouble with respect to the sensitivity of the article, and due to large amounts of duds, also leading to many unwanted unexploded devices in the battle field. So-called Exploding Foil Initiators (EFIs) have big advantages over standard initiators, because they are intrinsically safer (because instead of primary explosives secondary explosive are used), more reliable and functioning within a microsecond in stead of milliseconds. They also give new opportunities for smart munitions development. Because secondary explosives are used, the EFI can be place in line with the booster/main charge and fully electronic exploding initiator can be used. At this moment, Exploding Foil Initiators (EFI) are used only in expensive and timing dependent munitions systems. These devices are still inefficient and relatively big and also very expensive. From U.S. Pat. No. 4,862,803 an integrated silicon exploding initiator is known. However, the device is only partly integrated in silicon, and has a flyer formed from epitaxial silicon. This material disintegrates at high plasma temperature, rendering the device less suitable. The development of a smaller EFI is therefore desirable but needs an improvement of the system before it can be miniaturized.

WO9324803 discloses a integrated field effect initiator. An initiation electric potential is applied to a gate to effect field enhanced conduction in the path sufficient to allow vaporization of the path to cause initiation of an explosive material in contact with the path. However, this type of conductive bridge suffers from limited effectiveness as a foil initiator due to the limited amount of energy that a gated field effect transistor circuit can absorb in the bridge structure to receive a sufficiently large electrical current prior to vaporization.

SUMMARY

In an aspect of the invention there is provided the features listed in claims 1. In particular, an integrated circuit initiator device comprises a circuit substrate provided with an electrical insulating layer; an electrical conducting bridge circuit deposited on the insulating layer; said bridge circuit patterned as contact areas and a bridge structure connecting the contact areas, said bridge structure arranged for forming a plasma when the bridge structure is fused by an initiator circuit that contacts the contact areas; and a polymer layer that is spin-coated on the bridge structure, for forming a flyer that is propelled away from the substrate. The bridge circuit pattern is patterned in a doped silicon layer epitaxially deposited on the electrical insulating layer, wherein the doped silicon layer comprises a dopant from a group III element and wherein the bridge circuit pattern has an ohmic resistance less than $2*10^{-5}$ Ohm·m. It is found that the structure in this way has excellent initiator properties and can be fully mass produced by integrated silicon manufacturing processes.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION

Figure 1:
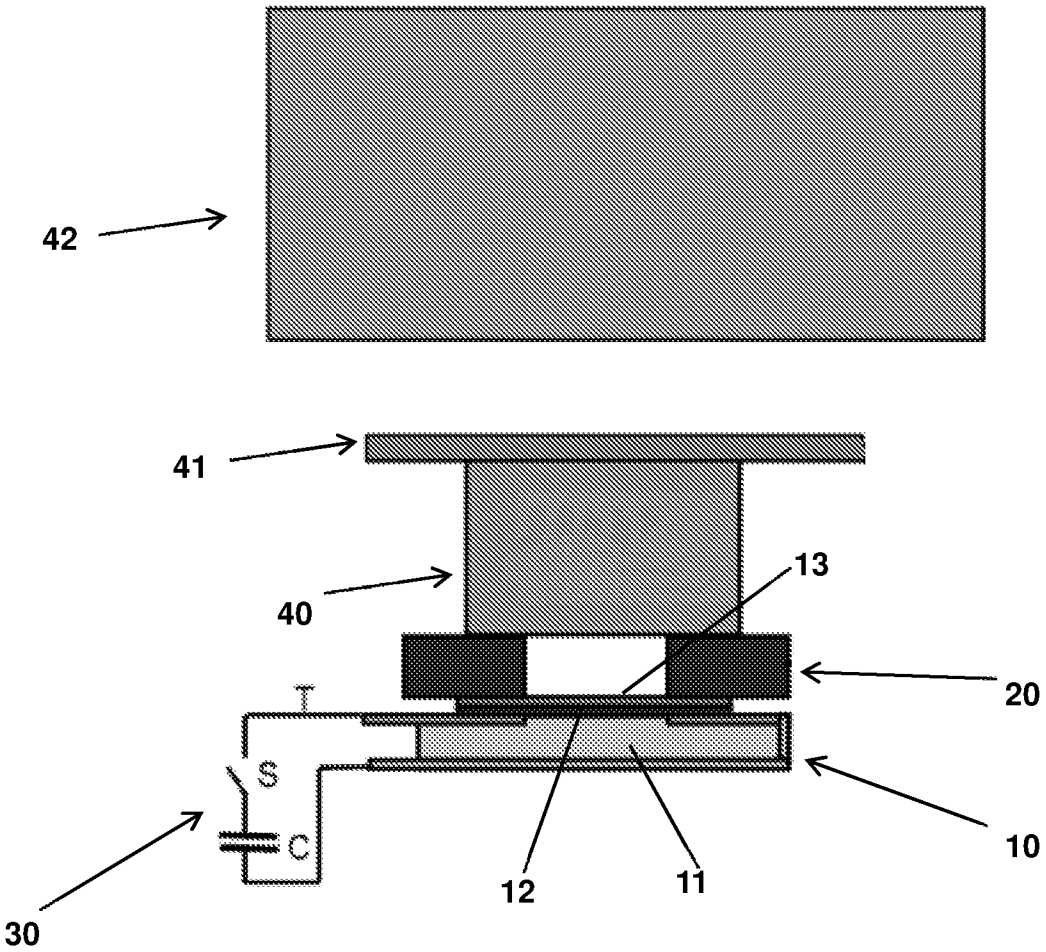
FIG. 1 shows an embodiment of an initiator device.

Unless otherwise defined, all terms (including technical and scientific terms) used herein have the same meaning as commonly understood by one of ordinary skill in the art to which this disclosure belongs as read in the context of the description and drawings. It will be further understood that terms, such as those defined in commonly used dictionaries, should be interpreted as having a meaning that is consistent with their meaning in the context of the relevant art and will not be interpreted in an idealized or overly formal sense unless expressly so defined herein. In some instances, detailed descriptions of well-known devices and methods may be omitted so as not to obscure the description of the present systems and methods. Terminology used for describing particular embodiments is not intended to be limiting of the invention. As used herein, the singular forms "a", "an" and "the" are intended to include the plural forms as well, unless the context clearly indicates otherwise. The term "and/or" includes any and all combinations of one or more of the associated listed items. It will be further understood that the terms "comprises" and/or "comprising" specify the presence of stated features but do not preclude the presence or addition of one or more other features. All publications, patent applications, patents, and other references mentioned herein are incorporated by reference in their entirety. In case of conflict, the present specification, including definitions, will control.

The term "integrated circuit initiator device" is used to denote that the initiator device is preferably integrally produced by layer deposition techniques to arrive at a layered substrate device, wherein the bridge circuit and flyer are integrated. A polymer layer may comprise several additives. It may be available in thin sheets in the order of 25-35 micron. It preferably has a very low thermal conductivity and high insulating capability. For example, is polyimide (PI) also well known under the name Kapton, is a dark brown and is mostly availably in thin but relatively large sheets. Alternatively, Parylene may be suitable.

The term "spin coating" is used in conventional way wherein the substrate is spun at high rotational frequency and cured at high temperature, in order to form a coated layer. Depending on a desired thickness of 25-35 microns several layers of material are applied, e.g. 2-15 layers. Depending on the curing process, the layer may shrink in the order of one third, which can be accounted for by increasing the number of layers. An important aspect in the assemblage of the flyer/bridge configuration production is the absence of air that could be trapped in between the polymer layers at the near the bridge. Voltage of 1200-1500 Volts may bridge a gap between the two transmission lines surface instead of a current over the bridge material itself. So an air gap trapped along the bridge may prevent the bridge from proper functioning. By the spin coating and subsequent curing process air inclusions may be prevented thereby improving the function of the bridge. In addition to spin coating other applications techniques e.g. sputtering or laminating may be feasible to achieve the same effect.

The product is subsequently cured at elevated temperature. The curing process is depends on the temperature. In an example production a polyimide layer may be heated to 350° C. in one hour and cured afterwards for 50 minutes at 350° C. The "circuit substrate" may be a silicon or silicon like substrate (e.g. pyrex). The "initiator circuit" may be a conventional circuit suitable for detonating an initiator device having a very low inductance; by fusing the bridge structure. The initiator circuit and bridge may also be combined on a single chip, or coupled in a MEMs device, e.g. via through silicon via connections.

Figure 4:
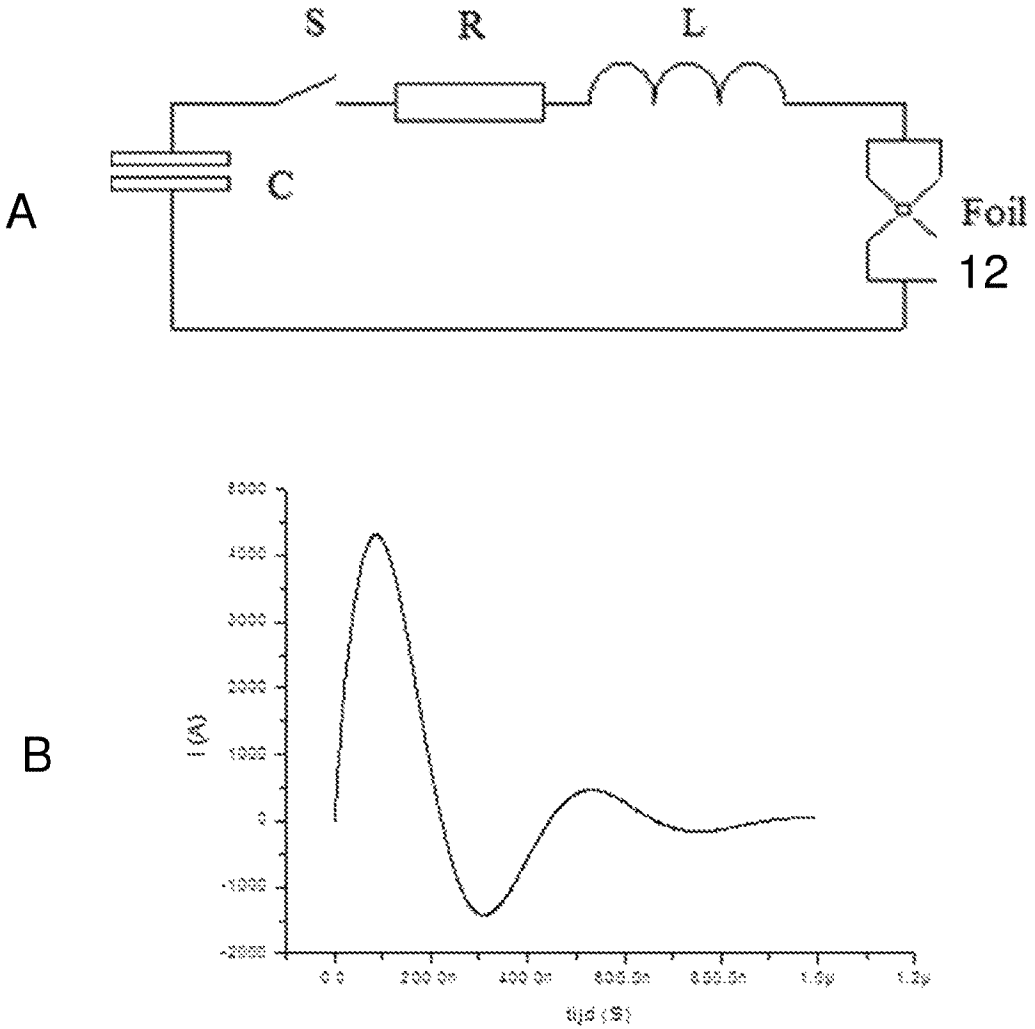
FIGS. 4A and B show a schematic graph of the initiator circuit.

Examples are described in FIG. 4.

FIG. 1 shows a microchip based exploding initiator device 10 in a setting of a primary and secondary explosive stage 40, 42. For instance the exploding initiator circuit 30, when shorted via the bridge circuit 12, forms a plasma when the bridge structure is fused. The initiator circuit 30 discharges a current into the bridge to heat and vaporize it within nanoseconds, whereby a flyer 13 is propelled away from the substrate 11 by said formed plasma through barrel structure 20. For example, initiator circuit 30 comprises a small capacitor C charged to a high voltage, a switch S, a transmission line T, an exploding foil 12 and an explosive 40. When the capacitor C is discharged via the transmission line T into the foil, the foil 12 will explode and propel the flyer 13 to a velocity well over 3 km/s, high enough to initiate an secondary explosive 30 such as HNS IV. The driver explosive 40 accelerates the secondary flyer 41 that initiates the booster explosive 42.

The more efficient the system is, the less energy is used in the system, the smaller the components become, giving the opportunity of down-scaling the system. The use of a solid state switch adds to increased efficiency and is more efficient than e.g. a often used spark gap. Furthermore, an efficient and inexpensive microchip based bridge is provided including a flyer material that produces the source for the initiation of the driver charge. While FIG. 1 shows an embodiment with a driver 40 and booster explosive 42, a microchip based exploding initiator device 10 may initiate or ignite all types of explosive substances, propellants or pyrotechnics, or be applied in more complex initiator schemes with multi-point initiation and multiple explosives or a primer that may be any energy conversion application, by initiation, combustion, detonation or similar. Applications may be in the field of explosives, combustion systems, pyrotechnic systems, airbag systems, propellants.

The bridge material 12, that will form the plasma propelling the flyer of the system, has a relatively low resistance for which the total dynamics of the electrical initiator circuit 30 is optimized so that most of the energy of the capacitor will be put in the bridge 12 of the EFI within a halve cycle. For example, without limiting in some applications a resistance around 2Ω appears to be a maximum value for the bridge resistance.

However, because of a critical detonation diameter of the explosive (HNS IV or V) of about 0.20-0.25 mm, a flyer of substantial size must be formed. So also the underlying bridge should have a size in the same order of magnitude. Because a plasma with a high temperature should be formed, a bigger bridge, means more material to heat and so more energy. However, the specific heat plays an important role in this calculation. The following table present the difference between the heating of a copper bridge in comparison to a bridge made from Aluminium or Silicon. For the calculation a bridge of the size of 200×300×5 micron is taken.

TABLE 2

Parameters and calculation of final temperature of bridge.

| Parameter | Copper | Silicon | Aluminum | |
|---|---|---|---|---|
| Density | 8.96 | 2.339 | 2.7 | g/cm3 |
| Length | 0.02 | 0.02 | 0.02 | Cm |
| Width | 0.03 | 0.03 | 0.03 | Cm |
| Height | 0.0005 | 0.0005 | 0.0005 | Cm |
| Volume | 0.0000003 | 0.0000003 | 0.0000003 | cm3 |
| Mass | 2.69E−06 | 7.017E−07 | 8.1E−07 | G |
| Molaire massa | 63.546 | 28.06 | 26.98 | G |
| # of moles | 4.23001E−08 | 2.50071E−08 | 3.002E−08 | Mol |
| Molar volume | 7.10E−06 | 1.21E−05 | 1.00E−05 | m3/mole |
| Volume gas | 3.0033E−13 | 3.03E−13 | 3.00E−13 | m3 |
| Melting Temperature | 1357 | 1683 | 933 | Kelvin |
| Boiling Temperature | 2843 | 3553 | 2743 | Kelvin |
| Energy used in system | 1.20E−01 | 1.20E−01 | 1.20E−01 | J |
| Specific heat | 3.80E−01 | 7.10E−01 | 0.88 | J/gK |
| Melting temperature | 1357 | 1683 | 933 | K |
| Energy up to melting | 1.39E−03 | 8.38E−04 | 6.65E−04 | J |
| Enthalpy for melting | 1.31E+04 | 5.05E+04 | 1.07E+04 | J/mole |
| Energy for melting | 5.52E−04 | 1.26E−03 | 3.22E−04 | J |
| Energy heating liquid | 1.52E−03 | 9.32E−04 | 1.29E−03 | J |
| Enthalpy of vaporization | 3.00E+05 | 3.84E+05 | 2.84E+05 | J/mole |

TABLE 2-continued

Parameters and calculation of final temperature of bridge.

| Parameter | Copper | Silicon | Aluminum | |
|---|---|---|---|---|
| Energy for vaporization | 1.27E−02 | 9.60E−03 | 8.53E−03 | |
| Totaal | 1.62E−02 | 1.26E−02 | 1.08E−02 | J |
| Energy left | 1.04E−01 | 1.07E−01 | 1.09E−01 | J |
| Total temperature increase | 1.02E+05 | 2.16E+05 | 1.53E+05 | K |

With values for density and volume, the mass of the bridge structure can be calculated. Using the value of the molar mass and the molar volume the volume of the gas formed from the solid bridge, can be calculated. Both materials give about the same volume of 3 $10^{-13}$ $m^3$ gas. Forming a plasma first the materials are heated up to the melting point, going through the melting phase, heating up to the boiling point and after that must be evaporated. Using the proper values for the specific heat, the Enthalpy of vaporization etc. the amount of energy needed to vaporise the bridge has been calculated. Taking a value of 0.12 J of energy that is available, the maximum temperature of the plasma can be determined for all materials. Although the specific heat of aluminium and silicon is about factor of 2 larger than copper the mass of aluminium is about a factor 3 smaller. This means that the maximum temperature of aluminium (150,000 K) is about a factor 1.5 larger than the temperature of copper (102,000 K) and for silicon even a factor of two (216,000 K). So, this shows that aluminium as a base material for the bridge is a better choice than e.g. copper, but surprisingly, silicon is even a better material and on the other hand producing the same amount of gas. When silicon is used as a bridge, a maximum temperature of about 216,000 K may be reached with the same amount of energy. The higher the temperature the higher the sound velocity of the gas and therefore the theoretical maximum velocity of the flyer.

The resistance strongly depends on the form, thickness and length-width ratio and should be rather low. A high resistance will not lead to a large current over the bridge and heating of the system will not take place as intended. Therefore, in several working systems metals such as copper or aluminium were used.

Another factor that is important is the resistance of the bridge during the plasma phase. Preferably, it does not rise to higher values for the same reason as mentioned before. A larger resistance will reduce the efficiency of the electrical process and not all energy will be induced in the bridge within a certain time. During the plasma phase, the resistance drop preferably in the order of a magnitude to increase the current in the system and fast heating of the plasma until an explosion occurs. Also for this aspect it is found that the resistance of metal bridges, but also a silicon bridge, drops fast and a large current is going through the circuit.

However, the inventors found to their surprise that a silicon resistance graph further differs from the metal graphs. Due to the temperature increase, the resistance has one peak for a metal bridge. First it increases and after that it is going over in to a plasma and the resistance drops to a low value and large currents can flow over the bridge. However, the highly doped silicon bridge has two peaks. One peak is the results of the metal character of the doped material that gives rise of the resistance and drops after that, and the second peak is due to the plasmafication process of the silicon giving rise to the resistance and a drop of it afterwards. After this second peak the resistance drops to a very low value. Metals such as Al and Cu can be suitably used for this purpose but extremely high doped silicon appears to be more efficient. For example, a range of about 1-4*$10^{19}$ atoms B/$cm^3$ can be doped in Si and a range of about 5-10*$10^{20}$ atoms/$cm^3$ in SiGe. Without being bound to theory, it is thought that this phased plasmafication process in doped silicon optimizes the current path in the bridge circuit, prior to plasmafication.

Figure 2:
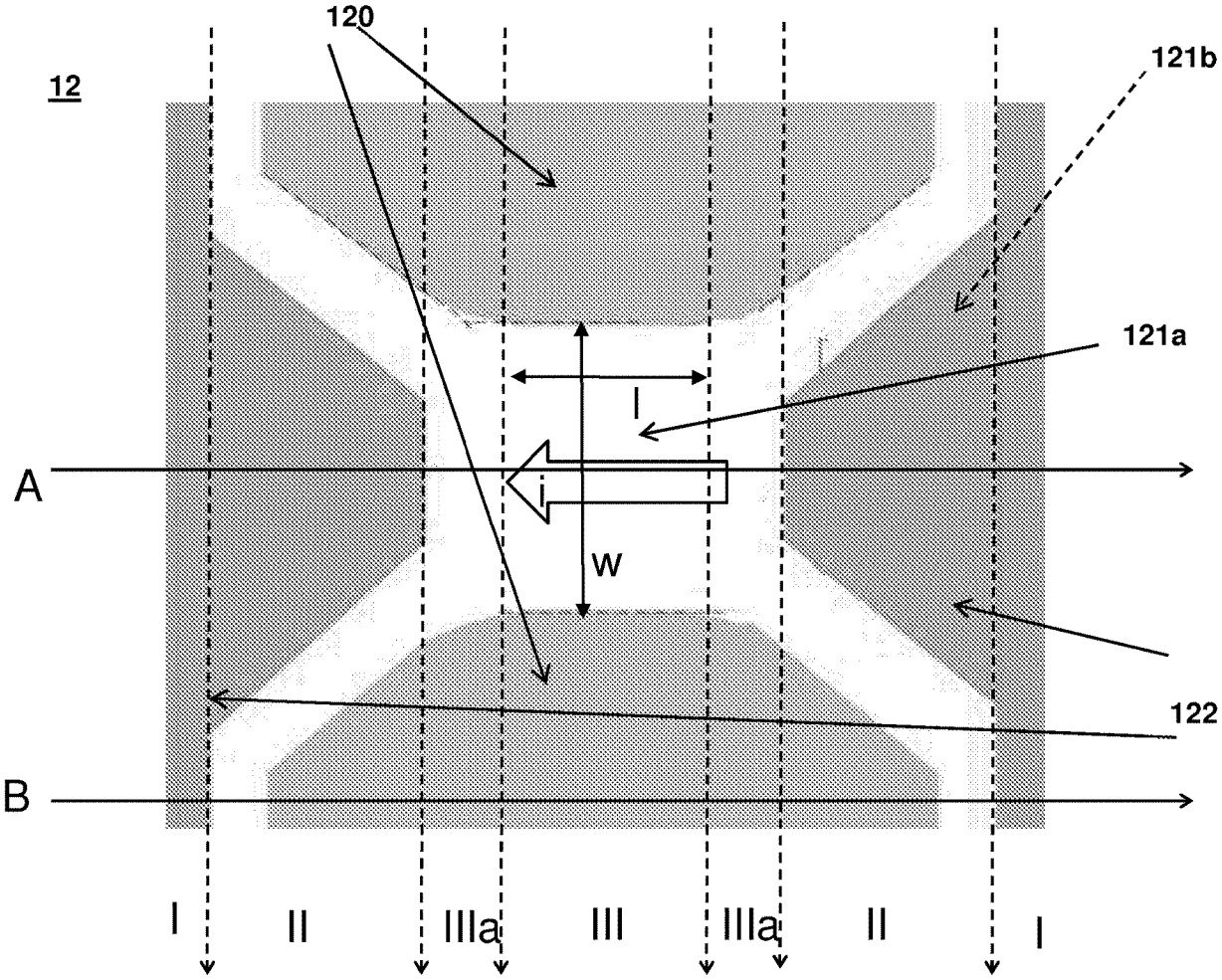
FIG. 2 shows a plane view of an embodiment of the invention.

FIG. 2 shows in more detail an embodiment of the bridge circuit 12 provided on a circuit substrate, for example a silicon substrate of the type shown in FIG. 1. A shock from a material with a relatively low shock impedance to a material with high shock impedance will be reflected for a large part. Other substrate materials with a high shock impedance are e.g. glass, ceramics or silicon having a high material sound velocities. Most of these materials can also be machined or manufactured that a flat surface is ensured. Ceramics or silicon have a large shock impedance due to the high sound velocity of these materials. So a shock from the exploding foil will be mostly reflected by a silicon tamper material instead of a Kapton tamper material.

Figure 3:
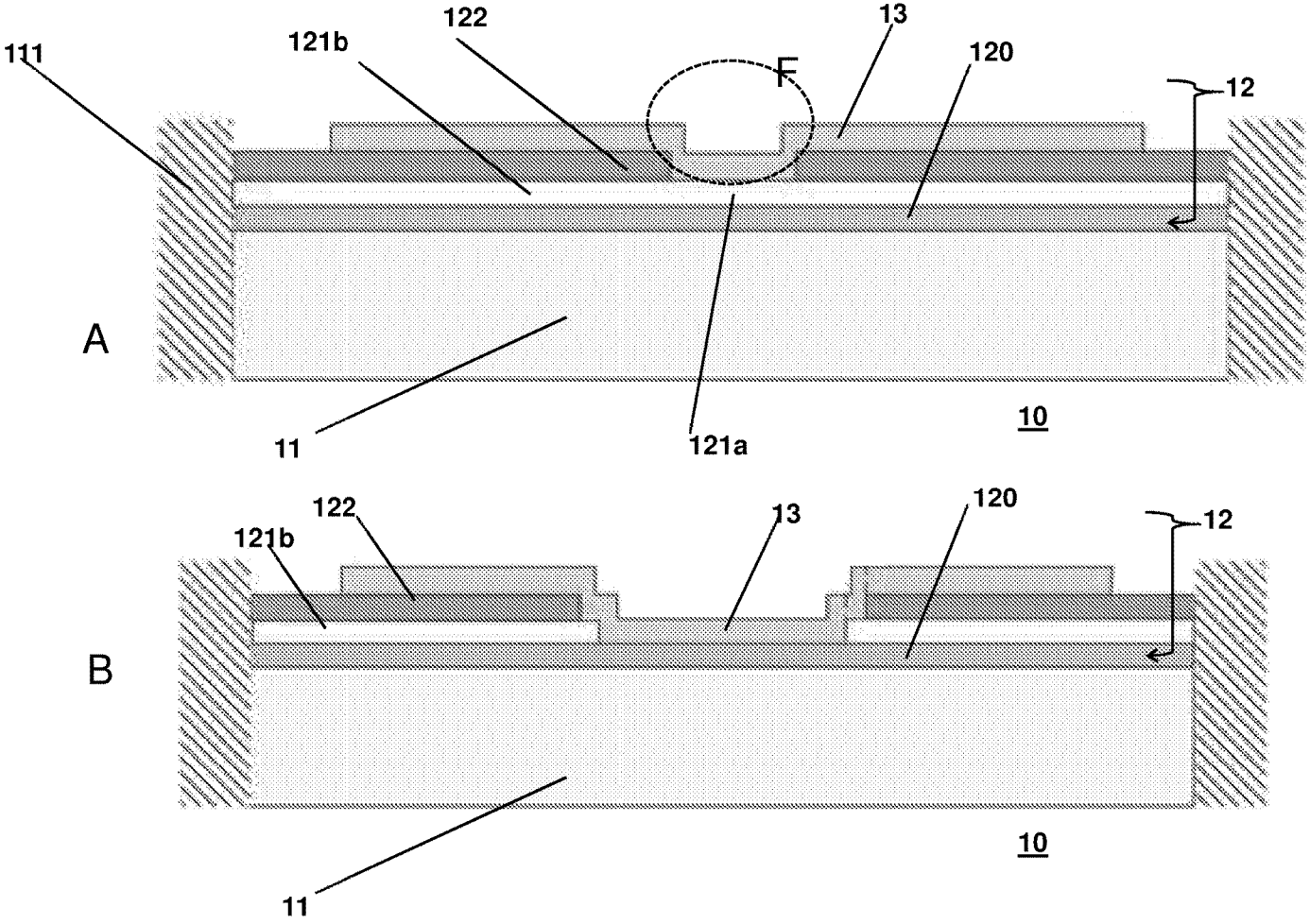
FIGS. 3A and B show first and second cross sectional views of the embodiment according to FIG. 1.

For ease of understanding no flyer layer is shown in this partial plan view, but FIGS. 3A and B show the orientation of flyer layer 13. The bridge circuit 12 is formed on an electrical insulating layer 120 that underlies patterned layer including a bridge structure 121*a* and contact areas 121*b*. Bridge structure 121*a* electrically connects the contact areas 121*b*, and is arranged for forming a plasma when the bridge structure 121*a* is fused by an initiator circuit. In a preferred example, metal interconnection pads 122 overlie the contact areas 121*b* of the bridge circuit 12 but other suitable connection to the initiator circuit are feasible. The bridge structure is formed by tapered zones II that extend from contact areas I into a bridging zone III defining a direction of current flow along a shortest connection path i between the contact areas I. The bridging zone III preferably has an elongation transverse to the shortest connection path i. That is, at least a part of the bridging zone III preferably has a width w defined between opposite parallel sides, that is longer than its length l, defined by the length of the parallel sides. In a further preferred embodiment the bridge zone is connected to the tapered zone II via rounded edges in a intermediate zone IIIa between the bridging zone III and tapered zone II, to optimize a current flow and optimize the plasma forming of the bridge structure 121, in particular in bridging zone III.

FIGS. 3A and 3B show a first and second cross sectional views of the embodiment according to FIG. 2 along the lines A and B respectively. FIG. 3A shows the silicon substrate 11, bounded by dicing areas 111 and underlying the bridge circuit 12. A kapton (polyimide) layer 13 is shown to be provided overlying and substantially conformal to the bridges structure 12.

Bridge circuit 12 is formed along line A as insulating layer. The electrical insulating layer is for example a silicon dioxide layer substantially overlying the silicon substrate 11 over its entire surface area. On the insulating layer 120, the bridge circuit layer 121 is formed. While several materials may be suitable, such as patterned Cu or Al layers, it is found that preferably, An initiator device according to claim 1, wherein the bridge circuit pattern is patterned in a doped silicon layer epitaxially deposited on the electrical insulating layer.

The doped silicon layer 121 may comprise a dopant from a group V element, however for this doping technique an element of group III has been used. For example a doping may be provided from phosphor or Boron, to include additional valence electrons. Doping levels can be optimized depending on the circuit properties and levels up to the theoretical maximum have been used. At these levels, the bridge circuit pattern has a very low ohmic resistance preferably less than $1*10^{-5}$ Ωm. The bridge circuit pattern 121 has a layer thickness preferably smaller than 4 μm.

The contact areas of the bridge circuit layer 12 are provided with overlying metal interconnection pads 122. The pads 122 can be electrically connected via transmission lines to the initiator circuit elaborated here below.

In FIG. 3A the polyimide layer 13 directly overlies the bridge circuit pattern, in particular bridge structure 121*a* that will fuse into a plasma when the initiator circuit unloads and the kapton layer 13 will be ruptured into a flyer in the area F. In FIG. 3B it is shown that the contact areas 121*b* are overlapped by the metal interconnection pads 122, and that the kapton layer 13 is spun directly on the insulating layer 120 underlying the bridge circuit pattern 121*a,b*.

An initiator device according to claim 1, wherein the polymer layer has a layer thickness smaller than 50 micron.

FIGS. 4(A and B) shows a generic set up of the foil, wherein L and R are substantially parasitic in nature, that is, as low as possible, and wherein, after closing switch S, the energy unloads in bridge circuit 12. The resistance of the bridge is important for the total functioning of the EFI because it is part of the dynamic discharge of the capacitor, after the closing of the switch, over the bridge. The electric circuit of the EFI system comprises of a Capacitor C, a Switch S and a transmission line which all may be provided by microcircuitry. The circuit has a parasitic induction L and a Resistance/impedance R.

De current of such a system can be described as:

$$I(t) = \frac{U_0}{\omega \cdot L} \exp(-t/\tau) \sin(\omega \cdot t) \tag{5.1}$$

With Uo the voltage over the capacitor

ω=(1/LC) the circular frequency

L=the induction of the circuit and

τ=(2L/R) the time constant of the circuit.

An example of such a discharge is found in FIG. 4B for discharge of 2 kV with C=250 nF, R=200 mΩ and L=20 nH.

Further Embodiments

Figure 5:
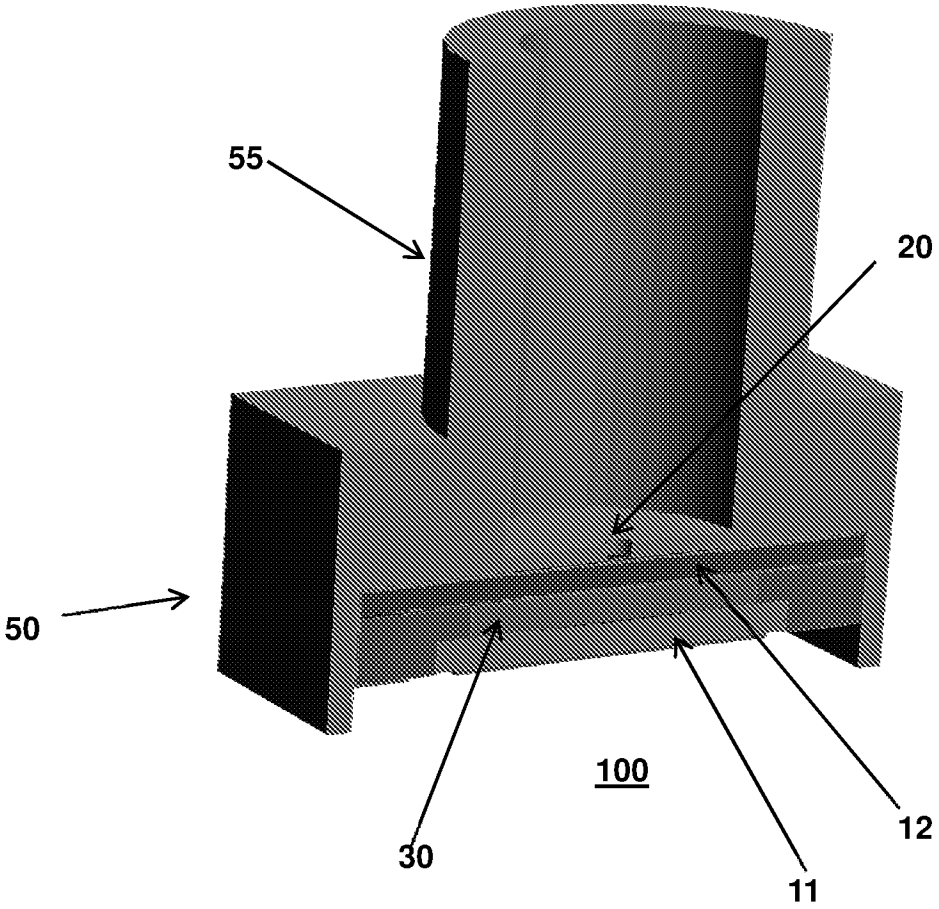
FIG. 5 shows a schematic cross sectional view of another embodiment of according to the invention.

FIG. 5 shows an embodiment wherein a micro chip based EFI exploding initiator 100 is provided in a barrel housing 50 that comprises parts of the exploding initiator, notably the bridge 12, initiator circuit 30 including a solid state switch, the connections, a barrel 20 and housing for an HNS pellet including a metal cup and a pellet holder 55, part of the polymer housing. In the figure a cross section drawing is shown of all components. The connection between the bridge 12 and the initiator circuit 30 can be provided by flat transmission lines made out of copper. The overall size is mainly dominated by the size of the HNS pellet with a height of about 10 mm.

Figure 6:
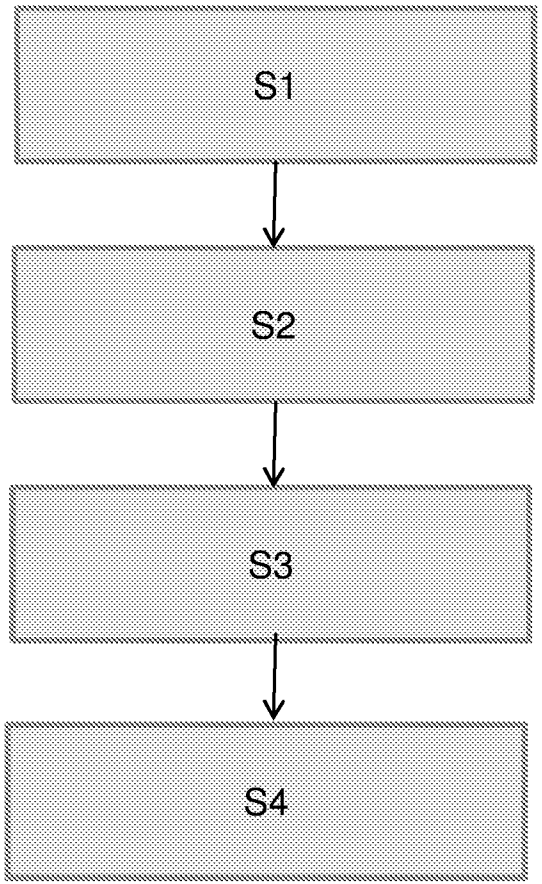
FIG. 6 shows schematically steps for manufacturing an initiator device.

FIG. 6 shows schematically the steps of providing a substrate (S1) with an electrical insulating layer; depositing an electrical conducting bridge circuit layer (S2) on the insulating layer; optionally sputtering of the aluminium lands on top of the EPI layer and patterning the bridge circuit layer in several etching and cleaning steps (S3) into a bridge circuit comprising contact areas and a bridge structure connecting the contact areas, said bridge structure arranged for forming a plasma when the bridge structure is fused by a initiator circuit that contacts the contact areas; and spin-coating (S4) a polymer layer, preferably in two or more coating iterations, e.g. 2-15 times, onto the bridge structure, for forming a flyer that is propelled away from the substrate. The bridge circuit is patterned to comprise contact areas and a bridge structure connecting the contact areas thereby arranged for forming a plasma when the bridge structure is fused by a initiator circuit that contacts the contact areas.

The whole process can be carried out with (epitaxial) silicon processes known to the skilled person. As a result the production can provide precise and reproducible products that can be produced in large quantities. Further features and advantages of this process are the following. Vapor deposition of thick layers of metals results in tension in the layer. The sputtering process may be a better solution.

Layers of several microns are possible but needs several processing steps errors are estimated in the range of 200-300 nm e.g. for Aluminum. A kapton layer can also processed in several layers. Errors in the size of layers within 2% should be possible, layer thickness is however more a problem due to the sensitivity of vaporization, sputtering and etching processes.

Other assembly techniques of a polyimide layer on top of a silicon based bridge may be less adequate and may destroy the bridge circuit. For this purpose a spinning technique of liquid polyimide (cured by high temperature) is advantageous. A different production technique with liquid polyimide has been used for this solid state device. The curing process depends on the temperature. The thickness of the polyimide layer depends strongly on the rotation velocity of the wafer and the viscosity of the material. Due to the difference in height of the different layers on the chip (about 7 microns higher Al layer on bridge layer and 3-4 micron down to the SiO2 layer, the spinning process results in a PI layer is 2-3 micron thicker on the bridge than on the Al-layer. This difference can be accounted for to get the right layer thickness around the exploding bridge area keeping in mind the shrinkage of the polymer layer during curing.

TABLE 1

Properties of PI as a function of curing process.

| Chemistry | Polyimide | | | | |
|---|---|---|---|---|---|
| Property/Cure Condition | 200° C./180 m | 220° C./180 m | 240° C./180 m | 250° C./90 min | 350° C./60 min |
| Tensile Strength, UTS, MPa | 139 +/− 15% | 147 +/− 15% | 149 +/− 15% | 145 +/− 15% | 162 +/− 15% |

TABLE 1-continued

Properties of PI as a function of curing process.

| Chemistry | Polyimide | | | | |
|---|---|---|---|---|---|
| Tensile Modulus, GPa | 3 +/− 15% | 2.9 +/− 15% | 2.9 +/− 15% | 3.2 +/− 15% | 3.3 +/− 15% |
| Elongation @ break | 41% +/− 15% | 55% +/− 15% | 68% +/− 15% | 72% +/− 15% | 85% +/− 15% |
| CTE1, ppm/° C. (25° C.-125° C.) | 37.87 | 32.59 | 30.52 | | |
| CTE2, ppm/° C. (100° C.-200° C.) | 51.78 | 60.24 | 61.15 | 59 | 52 |
| Tg, ° C. (DMA) | 235 | 240 | 245 | 248 | 265 |
| Decomposition Temperature, 2% | 285 | 298 | 305 | | |
| Decomposition Temperature, 5% | 315 | 325 | 330 | | 441 |

The disclosed product and processes have the advantage that it can be applied without any forces, accept the rotation of a wafer. It is applied in a liquid state and no air will be trapped below the layer. Depending on the curing temperature and time, material properties as maximum strain and tensile strength can be changed.

Layer thickness can be altered to any thickness needed up to about 100 microns.

The error in layer thickness may be in the order of +/−1.0 microns.

With a standard mask technique polyimide can be applied in any form or location on the wafer/die.

While example embodiments were shown for systems and methods, also alternative ways may be envisaged by those skilled in the art having the benefit of the present disclosure for achieving a similar function and result. E.g. some components may be combined or split up into one or more alternative components.

For example, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the scope of the present systems and methods as set forth in the claims that follow. The specifications and drawings are accordingly to be regarded in an illustrative manner and are not intended to limit the scope of the appended claims.

In interpreting the appended claims, it should be understood that the word "comprising" does not exclude the presence of other elements or acts than those listed in a given claim; the word "a" or "an" preceding an element does not exclude the presence of a plurality of such elements; any reference signs in the claims do not limit their scope; several "means" may be represented by the same or different item(s) or implemented structure or function; any of the disclosed devices or portions thereof may be combined together or separated into further portions unless specifically stated otherwise. The mere fact that certain measures are recited in mutually different claims does not indicate that a combination of these measures cannot be used to advantage.

The invention claimed is:

1. An integrated circuit initiator device comprising:

a circuit substrate upon which an electrical insulating layer is formed;

an electrical conducting bridge circuit formed on the electrical insulating layer, wherein said electrical conducting bridge circuit is patterned as:

a set of contact areas, and a bridge structure connecting together individual ones of the set of contact areas;

a flyer comprising a polymer layer spin-coated on the bridge structure;

wherein said bridge structure is configured to form a plasma when the bridge structure is fused by activating an initiator circuit when electrically coupled to at least one of the set of contact areas to provide an electrical current to the bridge structure through the at least one of the set of contact areas, wherein the flyer is propelled away from the substrate by said plasma formed after activating the initiator circuit, wherein the bridge circuit is patterned in a doped silicon layer epitaxially deposited on the electrical insulating layer, wherein the doped silicon layer comprises a dopant from a group III element, and wherein the bridge circuit pattern has an ohmic resistance less than $2*10^{-5}$ Ohm·m.

2. The initiator device according to claim 1, wherein the polymer layer has a layer thickness smaller than 50 microns.

3. The initiator device according to claim 2, wherein the polymer layer is patterned.

4. The initiator device according to claim 1, wherein the bridge structure has a layer thickness smaller than 4 microns.

5. The initiator device according to claim 1, wherein the bridge structure is formed as having a set of tapered zones that extend from the set of contact areas into a bridging zone to define a direction of current flow along a shortest connection path between the contact areas; and wherein said bridging zone has an elongation transverse to the shortest connection path.

6. The initiator device according to claim 5, wherein the bridging zone is connected to the set of tapered zones via rounded edges.

7. The initiator device according to claim 1, wherein the electrical insulating layer comprises a silicon dioxide insulating material.

8. The initiator device according to claim 1, wherein the set of contact areas comprise metal interconnection pads.

9. The initiator device according to claim 8, wherein the metal interconnection pads are formed by aluminum deposition extending into the tapered zones.

10. The initiator device according to claim 1, further comprising a barrel structure for guiding the flyer along a path after the bridge structure forms the plasma.

* * * * *